US011746996B2

(12) United States Patent
Smith et al.

(10) Patent No.: US 11,746,996 B2
(45) Date of Patent: Sep. 5, 2023

(54) ADAPTER ASSEMBLY FOR LUMINAIRE

(71) Applicant: SPA ELECTRICS PTY LTD, Dandenong (AU)

(72) Inventors: Charles Smith, Dandenong (AU); Mathew Rust, Dandenong (AU); Elizabeth Christmas, North Melbourne (AU); Marcus Krigsman, North Melbourne (AU); Margaux Hayes, North Melbourne (AU); Thi Thanh Thao Nguyen, North Melbourne (AU); Josh Bell, North Melbourne (AU)

(73) Assignee: SPA ELECTRICS PTY LTD, Dandenong (AU)

( * ) Notice: Subject to any disclaimer, the term of this patent is extended or adjusted under 35 U.S.C. 154(b) by 0 days.

(21) Appl. No.: 17/753,848

(22) PCT Filed: Sep. 11, 2020

(86) PCT No.: PCT/AU2020/050973

§ 371 (c)(1),
(2) Date: Mar. 16, 2022

(87) PCT Pub. No.: WO2021/051159

PCT Pub. Date: Mar. 25, 2021

(65) Prior Publication Data

US 2022/0341573 A1 Oct. 27, 2022

(30) Foreign Application Priority Data

Sep. 17, 2019 (AU) ..... 2019903454

(51) Int. Cl.
*F21V 21/04* (2006.01)
*E04H 4/14* (2006.01)
(Continued)

(52) U.S. Cl.
CPC ..... *F21V 21/047* (2013.01); *E04H 4/148* (2013.01); *F21S 8/024* (2013.01); *F21V 17/18* (2013.01); *F21W 2131/401* (2013.01)

(58) Field of Classification Search
CPC .. F21V 17/18; F21V 21/047; F21W 2131/401
See application file for complete search history.

(56) References Cited

U.S. PATENT DOCUMENTS 4,971,283 A 11/1990 Tilsner
8,403,513 B2 3/2013 Drury
(Continued)

FOREIGN PATENT DOCUMENTS

EP 1936257 A1 6/2008
EP 2746643 A1 6/2014
(Continued)

*Primary Examiner* — Leah Simone Macchiarolo
(74) *Attorney, Agent, or Firm* — Vorys, Sater, Seymour, and Pease LLP

(57) ABSTRACT

An adapter assembly for securing a luminaire to a niche formed in a wall of a pool or spa. The assembly comprises a mounting bracket having a rear portion shaped and sized to fit within the niche and a front portion comprising a peripheral flange sized to engage the wall surrounding the niche. The mounting bracket enables the luminaire to be secured thereto and be visible from a front side thereof. The assembly includes at least one clamping device attached to the rear portion of the mounting bracket and configured to secure the mounting bracket to the niche. In a preferred embodiment, the clamping device comprises a clamping arm and drive member. The clamping arm is pivotally connected to the mounting bracket such that the mounting bracket is drawn into the niche and the peripheral flange of the mounting bracket is drawn towards the wall surrounding the niche.

11 Claims, 16 Drawing Sheets

(51) Int. Cl.

| | |
|---|---|
| ***F21S 8/02*** | (2006.01) |
| ***F21V 17/18*** | (2006.01) |
| *F21W 131/401* | (2006.01) |

(56) References Cited

U.S. PATENT DOCUMENTS

| | | | | |
|---|---|---|---|---|
| 11,076,211 | B2 * | 7/2021 | Hart | H04R 1/025 |
| 2007/0170322 | A1 | 7/2007 | Francois | |
| 2010/0252703 | A1 * | 10/2010 | Wright | H04R 1/025<br>248/221.11 |
| 2013/0039037 | A1 | 2/2013 | Drury | |
| 2018/0202645 | A1 | 7/2018 | Potucek et al. | |
| 2018/0223553 | A1 * | 8/2018 | Thompson | F21V 17/12 |
| 2020/0200200 | A1 * | 6/2020 | Oh | F16B 37/0864 |

FOREIGN PATENT DOCUMENTS

| | | | |
|---|---|---|---|
| EP | 3101326 | A1 | 12/2016 |
| ES | 1224323 | U | 2/2019 |
| GB | 928004 | A | 6/1963 |

* cited by examiner

ADAPTER ASSEMBLY FOR LUMINAIRE

CROSS-REFERENCE TO RELATED APPLICATIONS

This application claims priority from Australian provisional patent application number 2019903454 filed on 17 Sep. 2019, the entire content of which is incorporate herein by cross reference.

FIELD OF THE INVENTION

The present invention relates to an adapter assembly suitable for use in mounting underwater luminaires, such as pool or spa lights, to niches formed in a wall of a pool or spa. The assembly is especially suitable for retrofitting swimming pool and spa luminaires in-situ and without the need for repair, modification or adjustment of the existing niche.

It will be convenient to describe the invention in relation to pool lights but it should be understood that the adapter assembly is capable of broader application and use. For example, the adapter assembly may also be used for securing underwater lights in ponds or fountains, or it may be used above water, such as in applications where a light (or other similar fixture) is to be recessed within a niche formed in a horizontal or vertical surface. Some examples include in-ground lamps installed in pathways, lawns or flower beds, or recessed lamps installed in a wall, floor or ceiling of a building.

BACKGROUND TO THE INVENTION

In many swimming pools and spas across North America, Europe and Asia, there exist a range of underwater luminaire niches designed to house luminaires and supporting cable, etc. Sizes vary by company due to the manufacturing techniques involved.

These niches, while produced by different manufacturers over different eras, are all based on a common format, although they vary in size and geometry and are all subject to similar damage and degradation over time.

Due to their design and construction material, the most common form of such damage is breakage of the mounting hardware (either by physical damage, corrosion or mechanical failure) used to attach the luminaire to the niche.

As this mounting hardware has not been designed to be readily replaced or serviced, there are currently no reliable options to repair this damage without significant cost. As the niches form part of the pool wall construction, removal or replacement of the niche is cost prohibitive and requires significant renovation not only to the interior of the pool but also the surrounding area behind the pool walls.

There have been several attempts to resolve this problem, however the solutions introduced new problems, or were cumbersome or difficult to install, or prone to the same failures as the original design.

One example is described in U.S. Pat. No. 4,971,283 to Herbert L. Tilsner, entitled "Pool Light Wedge", and sold by Custom Molded Products, Inc. FIGS. 8 and 9 of this US patent are reproduced herein as FIGS. 1 and 2, respectively, of the accompanying drawings. The product comprises a wedge device 100 for use in mounting a swimming pool light 102 in a niche 104 formed in a wall 106 of the pool. It has a wedge member 108 and a drive member 110 for use in driving the wedge member 108 between the side of the light 102 and the wall of the niche 104. A screw 112 threadably engages the drive member 110 and is inserted through an aperture in a mounting ring 114 for the light. When the screw 112 is tightened against the mounting ring 114, it draws the wedge member 108 against a side of the light 102 and the wall of the niche 104 thereby wedging the light in place.

This product is however designed for use when the original "top screw" position of the niche is broken or damaged. It functions by providing a mechanical wedge between the niche wall and luminaire fitting, effectively securing the light into position. While the device can provide a means of securing a luminaire in some cases, it is only suitable where the original "bottom hook" location 116 of the niche remains serviceable, and it requires the dimensions of the light fitting match the wedge profile. Due to its wedge design, it also applies excessive stress on the luminaire itself.

Another example is described in European Patent No. EP 1936257 by Bega Gantenbrink Heiner and entitled "In-ground Lamp". FIG. 1 of this patent is reproduced as FIG. 3 of the accompanying drawings. This traversable in-ground lamp 120 has a light housing 122 protruding into a hollow chamber or niche 124. The light housing 122 has a wedge-shaped clamping block 126 arranged in a sliding manner and has a projection arranged in the light housing 122. The clamping block 126 is pulled towards the light housing 122 by a slide track 128 to secure the light housing 122 in the hollow chamber 124.

It can be seen from the drawing that this product adopts a different mechanical design to that disclosed in U.S. Pat. No. 4,971,283, although with similar intent to fit a lamp within a cylindrical niche. However, this approach has limited applicability. The displacement of the clamping block 126 is limited and suitable only for a predetermined size niche with allowance for tolerance.

A further product aimed at addressing the problem of retrofitting a pool light to a niche is described in U.S. Pat. No. 8,403,513 by William Drury and assigned to Custom Moulded Products, Inc. This patent is entitled "Pool Light Adaptor Ring" and discloses an adapter ring 130 for retrofitting a pool light in a pool wall niche. FIG. 1 of this US patent is reproduced as FIG. 3 of the accompanying drawings. The adapter ring 130 has a pair of interlocking hooks 132 to allow the ring to be compressed to a first, compressed state, inserted into a wall niche and then relaxed to a second, rigid state. The adapter ring has mounting brackets 134, 136 attached to the ring for receipt of a pool light or other device. The adapter ring 130 also has a plurality of anchor screws 138 for securing the adapter ring inside the niche.

As such, this device is also designed to fix against the inner wall of the existing niche, using an array of compression points, and provide new mounting hardware for attachment of the light. The device is secured in place by tightening the anchor screws 138 against the niche wall to provide a compression fit against the niche. This attachment method generates focused points of load which can damage some niche types (e.g. plastic formed) and potentially cause failure.

The process of installation also causes part deformation which can alter the mounting locations provided and prevent light attachment or increase the difficulty in installation.

The device's construction is also of stainless steel which, when installed against a metal niche wall, can generate crevice and/or galvanic corrosion depending on the niche construction material and chemical composition of the surrounding water. This process can thereby reduce structural integrity of the niche as well as generate staining or discolouring of the pool surface, requiring additional repair.

With the foregoing in mind, there remains a need for an adapter and/or bracket assembly to enable a luminaire to be securely retrofitted to an existing niche in a pool wall, especially in circumstances where the original fixing hardware at the niche opening is no longer usable due to mechanical damage or corrosion. The present invention is directed to meeting this need, or at least to provide a useful alternative to existing products.

Any discussion of documents, devices, acts or knowledge in this specification is included to explain the context of the invention. It should not be taken as an admission that any of the material formed part of the prior art base or the common general knowledge in the relevant art on or before the priority date of the claims herein.

SUMMARY OF THE INVENTION

The present invention provides an adapter assembly suitable for securing a luminaire to a niche formed in a wall of a pool or spa. The adapter assembly comprises:

a mounting bracket having a rear portion shaped and sized to fit within the niche and a front portion comprising a peripheral flange sized to engage the wall surrounding the niche, the mounting bracket also being configured to enable the luminaire to be secured thereto and be visible from a front side thereof; and at least one clamping device attached to the rear portion of the mounting bracket and being configured to secure the mounting bracket to the niche.

A primary advantage of this adapter assembly is that it reduces the likelihood of subsequent damage to the new luminaire once mounted to the existing niche. In this regard, pool lights are susceptible to mechanical damage from users. For example, when a person is swimming laps of a pool, they would typically "kick off" from the pool wall when reversing direction. If a pool light happens to be located in the pool wall at that location, then the light takes the full impact of the user's foot kicking against the cover of the light. A similar situation may occur if a swimmer inadvertently kicks a pool light as they climb out of the pool.

This impact puts considerable stress on the peripheral edges of the luminaire, especially at the locations where the peripheral edge is secured to the opening of the niche. These localised stress points cause the plastic material of the luminaire to crack and eventually fail.

In the adapter assembly of the present invention, the luminaire is not fixed directly to the opening of the niche in the pool wall. Instead, the mounting bracket is secured to the niche and then the luminaire is secured to the mounting bracket (although not necessarily installed in this order). The mounting bracket is therefore interposed between the luminaire and the pool wall, acting to some degree as a shock absorber. The mounting bracket, rather than the luminaire, absorbs the forces applied to the fixing points if the luminaire is inadvertently kicked by a user. If the impact is of sufficient strength to cause a failure, it is likely to be the mounting bracket which fails rather than the luminaire. This is advantageous because the mounting bracket would be far cheaper to replace than would be the luminaire.

In a preferred embodiment of the adapter assembly, the clamping device comprises a clamping arm and drive member. The drive member is preferably accessible from the front side of the mounting bracket when the rear portion is positioned within the niche such that, in use, the drive member is operable to drive the clamping arm towards an internal wall of the niche to thereby secure the mounting bracket to the niche.

In a particularly preferred embodiment, the clamping arm is pivotally connected to the mounting bracket such that, when operated by the drive member, a free end of the clamping arm moves forwardly towards the front portion of the mounting bracket as it moves outwardly, away from a central axis of the mounting bracket and towards the internal wall of the niche. In this way, the combined movement causes the mounting bracket to be drawn further into the niche and the peripheral flange of the mounting bracket to be drawn towards the wall surrounding the niche.

In one embodiment, the clamping arm comprises a rigid substrate material and the free end of the clamping arm includes a flexible material overlying the rigid substrate material so as to provide a degree of compliance as the free end of the clamping arm engages the internal wall of the niche. During manufacture, the flexible material may be over-moulded on the rigid substrate material of the free end of the clamping arm.

Advantageously, the flexible material may be provided with a toothed or notched profile to increase grip with the internal wall of the niche. In a particular embodiment, the toothed or notched profile may have an asymmetrical shape to provide a greater degree of friction with the internal wall of the niche in one direction than in the other direction, to thereby resist unintended removal of the adapter assembly from the niche. This embodiment may also assist installation of the mounting bracket into the niche but resist dislodgement. If, however, the mounting bracket does need to be removed, this can easily be achieved by reverse operation of the drive member.

In a preferred embodiment the drive member comprises a threaded bolt that is arranged to engage a threaded bore or nut within the clamping arm. The nut may be captured within a cavity formed in the rigid material of the clamping arm. Preferably, the threaded bolt has a head which projects through an aperture in the mounting bracket so as to be accessible from the front side of the mounting bracket when positioned within the niche.

The clamping device may also include stop members to limit movement of the clamping arm to within predefined travel limits. This arrangement may help to prevent the clamping device becoming inoperative, due to disengagement of a threaded bolt from the nut, and also simplify installation by ensuring that the position of the clamping arm stays within known limits.

In a preferred embodiment, three clamping devices are provided, although some combination of fixed and adjustable clamping devices may be employed. If there are three adjustable clamping devices, they are preferably substantially equally spaced around the mounting bracket.

Comprises/comprising and grammatical variations thereof when used in this specification are to be taken to specify the presence of stated features, integers, steps or components or groups thereof, but do not preclude the presence or addition of one or more other features, integers, steps, components or groups thereof.

To assist the further understanding of the invention, reference is now made to the accompanying drawings which illustrate preferred embodiments of the invention. Other embodiments of the invention are possible, and consequently the particularity of the accompanying drawings is not to be understood as superseding the generality of the preceding description of the invention.

DETAILED DESCRIPTION OF PREFERRED EMBODIMENTS

Figure 1:
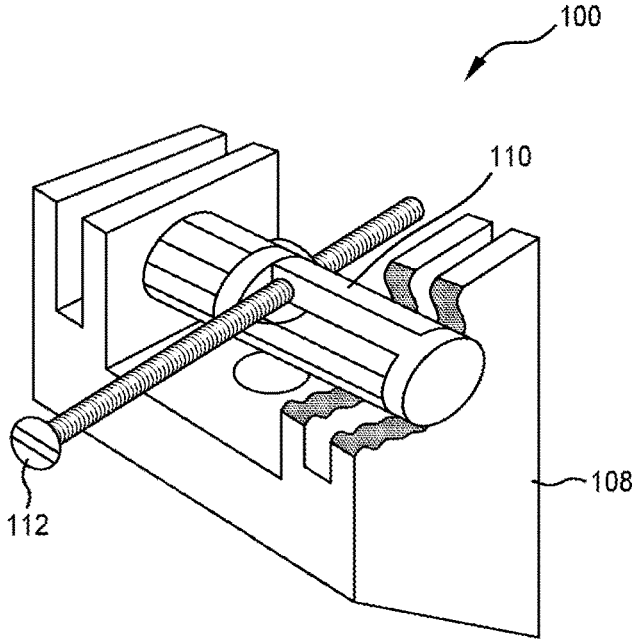
PRIOR ART Figure 1
FIGS. 1 and 2 show a prior art product as described in U.S. Pat. No. 4,971,283.
Figure 2:
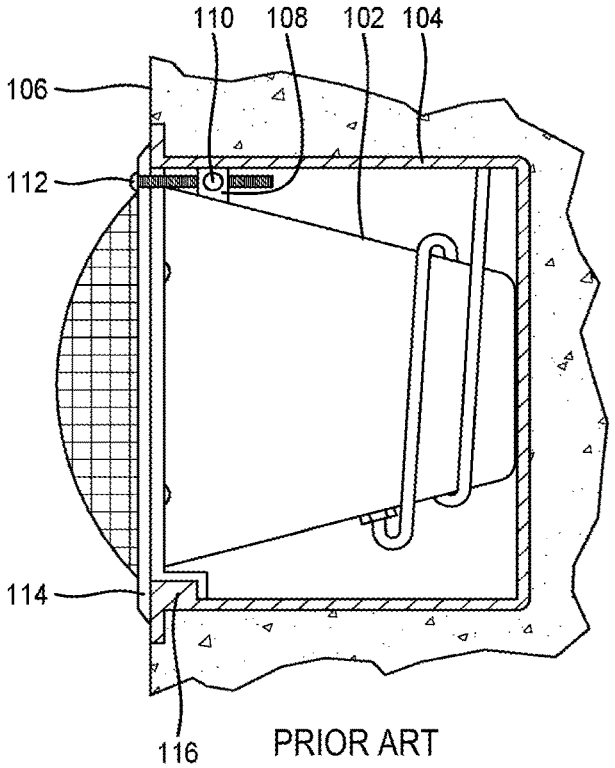
PRIOR ART Figure 2
Figure 3:
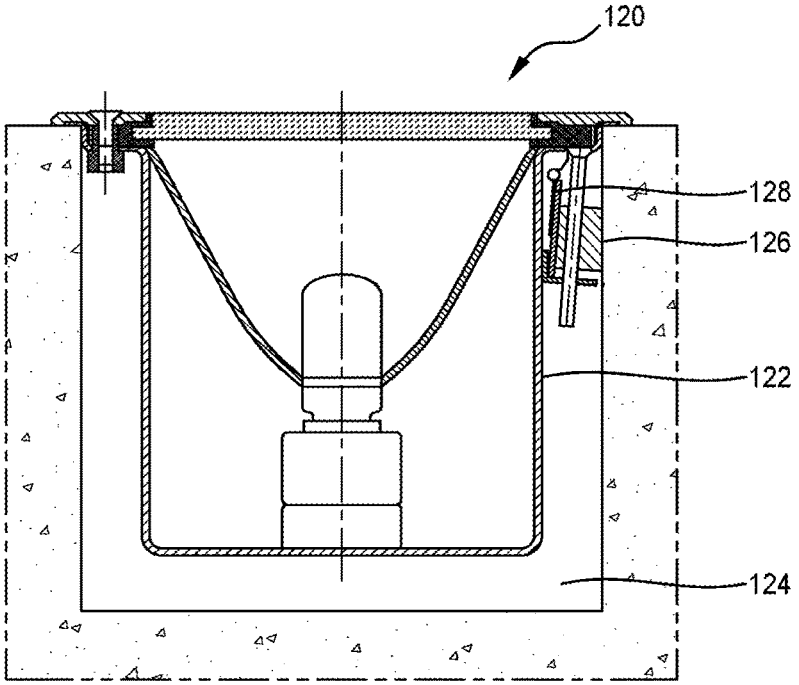
PRIOR ART Figure 3
FIG. 3 shows another prior art product as described in European Patent No. EP 1936257.
Figure 4:
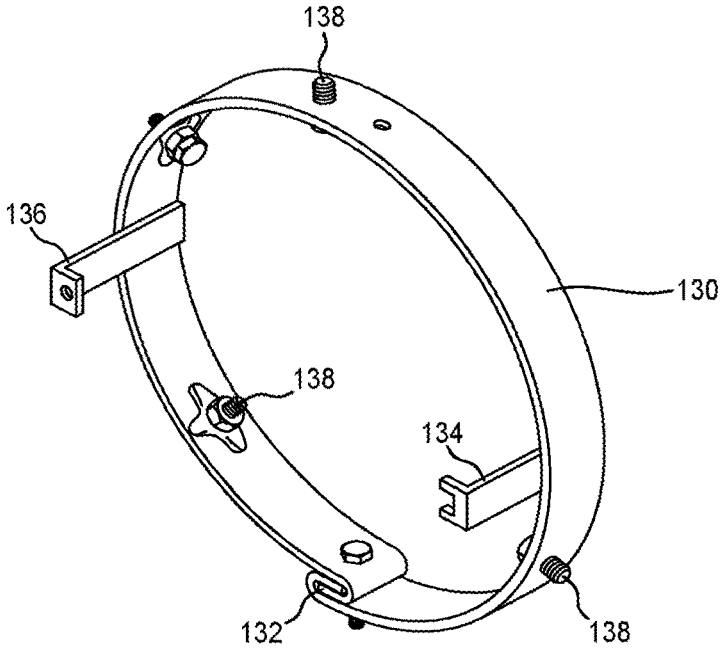
PRIOR ART Figure 4
FIG. 4 shows a further prior art product as described in U.S. Pat. No. 8,403,513.
Figure 5:
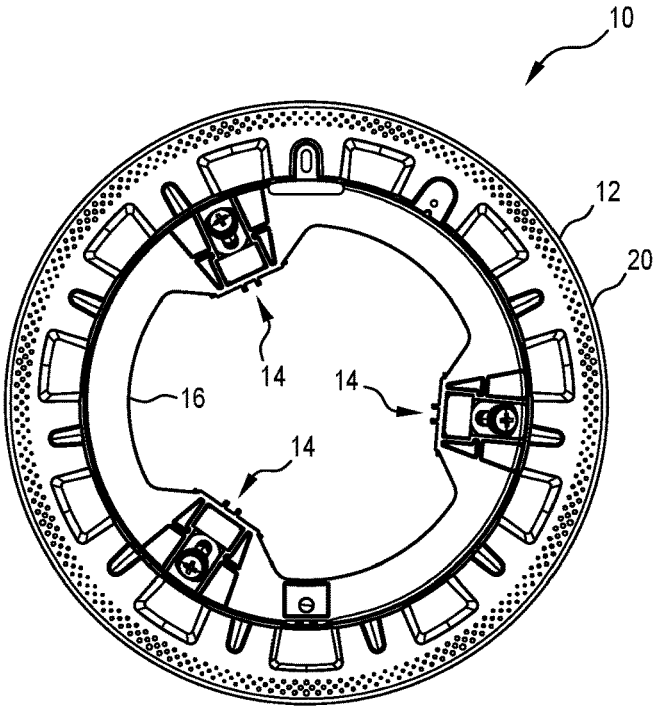
FIG. 5 is a front view of an adapter assembly for securing a luminaire within a niche formed in a wall of a swimming pool or spa, in accordance with a preferred embodiment of the invention.
Figure 6:
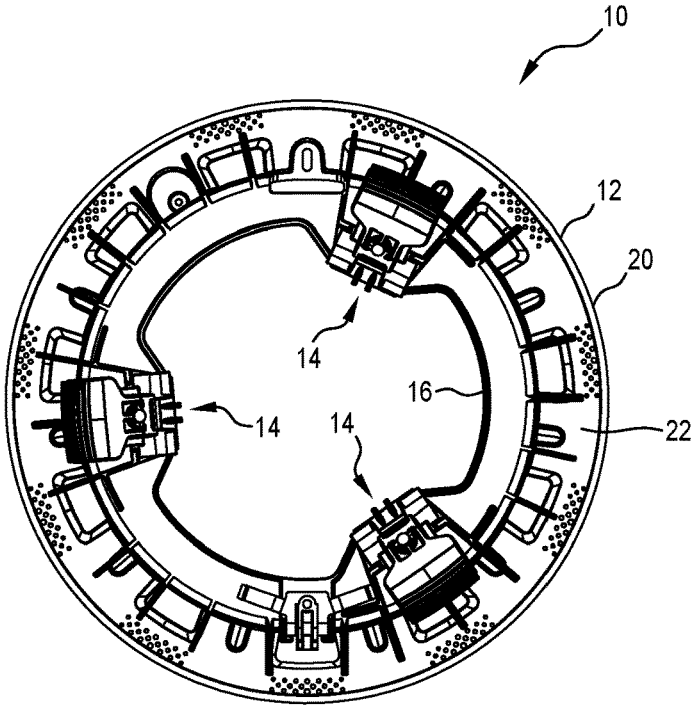
FIG. 6 is a rear view of the adapter assembly.
Figure 7:
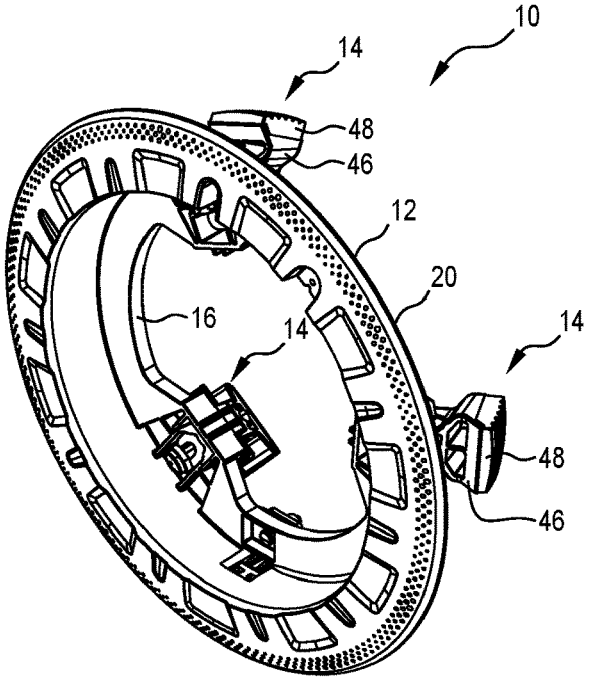
FIG. 7 is a front isometric view of the adapter assembly.
Figure 8:
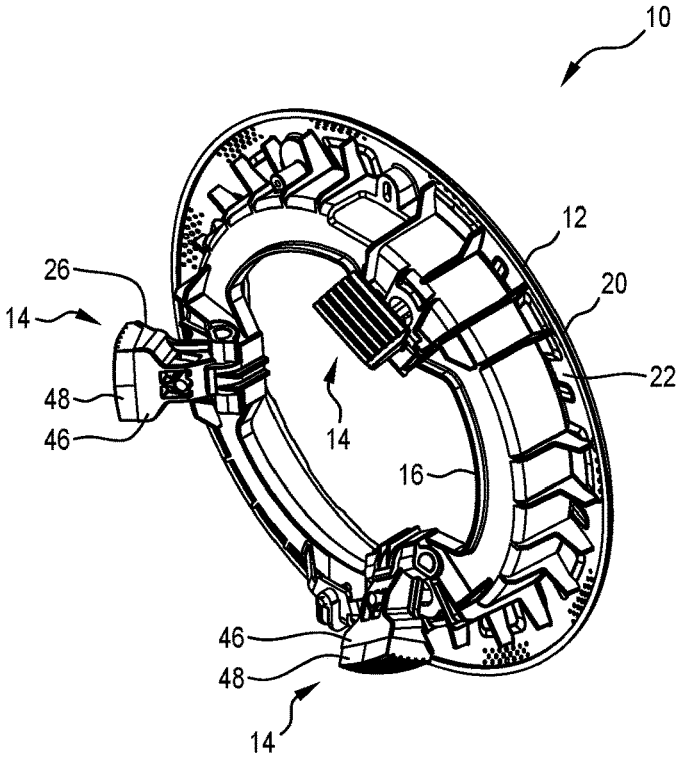
FIG. 8 is a rear isometric view of the adapter assembly.

An adapter assembly in accordance with a preferred embodiment of the invention is shown in FIGS. 5 to 12 of the accompanying drawings. Where the same component is shown in multiple figures, the same reference numbers are used.

The adapter assembly is suitable for securing a luminaire to a niche formed in a wall of a pool or spa. It could, however, also be used for other purposes, such as in above-ground lighting in a path or driveway.

The adapter assembly 10 comprises a mounting bracket 12 and three clamping devices 14. The mounting bracket 12 has a rear portion 16 which is shaped and sized to fit within the niche 18 (see FIG. 12) and a front portion 20 comprising a peripheral flange 22 sized to engage the wall 24 (see FIG. 12) surrounding the niche 18. The mounting bracket 12 is configured to enable a luminaire (not shown) to be secured thereto and be visible from a front side of the mounting bracket.

The three clamping devices 14 are positioned equally around a central axis of the mounting bracket 12. Each clamping device 14 is attached to the rear portion 16 of the mounting bracket 12 and comprises a clamping arm 26 and drive member 28. The drive member 28, in the form of a threaded bolt 30, is arranged to engage a threaded nut 32 captured within the clamping arm 26. In the embodiment shown, the bolt 30 is 6 mm in diameter and has a metric screw (referred to as M6) and the nut 32 has a corresponding M6 internal thread. However, any alternative size and/or thread, imperial or metric, could instead be used.

In the embodiment shown, the M6 nut is captured within the material of the clamping arm 26 at the time of manufacture, so it cannot be lost during installation.

The bolt 30 has a head 34 which projects through an aperture in the mounting bracket 12 and be accessible from the front side of the mounting bracket 12 when positioned within the niche 18. In the embodiment shown, the head 34 is configured to be engaged by a Phillips head screwdriver such that the bolt 30 is operable with a conventional manual or powered screwdriver to drive the clamping arm 26 towards an internal wall 36 of the niche 18, to thereby secure the mounting bracket 12 to the niche 18. It will be appreciated however that provision for a flat-blade screwdriver could alternatively be provided.

Figure 9:
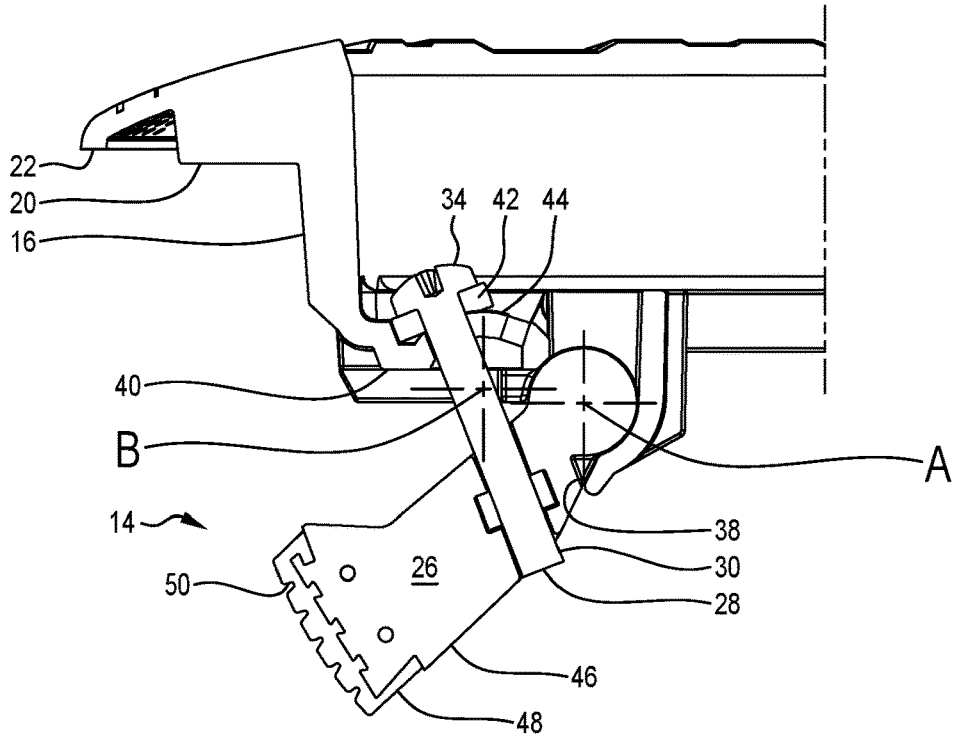
FIG. 9 is a partial cross-sectional side view of the adapter assembly showing a clamping arm in an inoperative position.
Figure 10:
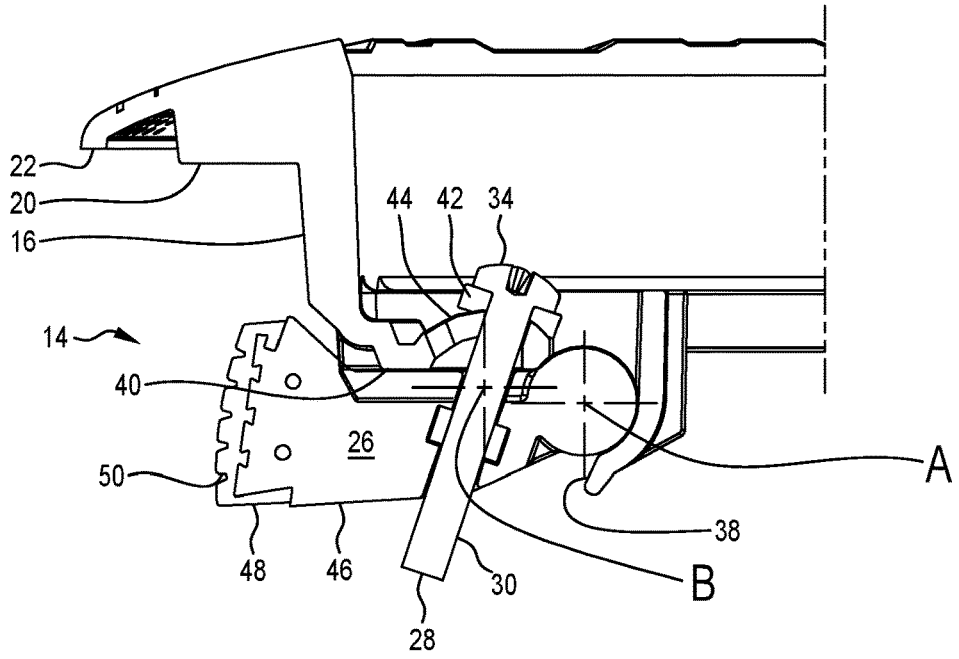
FIG. 10 is a partial cross-sectional side view of the adapter assembly showing the clamping arm in an operative position.

In the embodiment shown in FIGS. 5 to 12, the clamping arm 26 is pivotally connected to the mounting bracket 12 about an axis A (see FIG. 9) such that rotation of the threaded bolt 30 causes a free end of the clamping arm 26 to move in an arc, forwardly towards the front of the mounting bracket 12 as it moves outwardly away from the central axis of the mounting bracket and towards the internal wall 36 of the niche 18 (see FIG. 10). This combined movement causes the mounting bracket 12 to be drawn into the niche 18 and the peripheral flange 22 of the mounting bracket to be drawn towards the pool wall 24 (see FIG. 12) surrounding the niche 18.

FIG. 9 of the accompanying drawings shows the clamping device 14 in an initial, inoperative position, with the clamping arm 26 at a most extreme end of its travel range, abutting a hard stop 38. This position provides the most clearance from the internal wall 36 of the niche 18 to facilitate easy installation.

Conversely, FIG. 10 shows the clamping device 14 in an operative position, with the clamping arm 26 at the opposite extreme of its travel range, abutting a second stop 40. This position provides interference to the niche wall 36 (see FIG. 12) and thus applies maximum clamping force against the niche wall.

Figure 12:
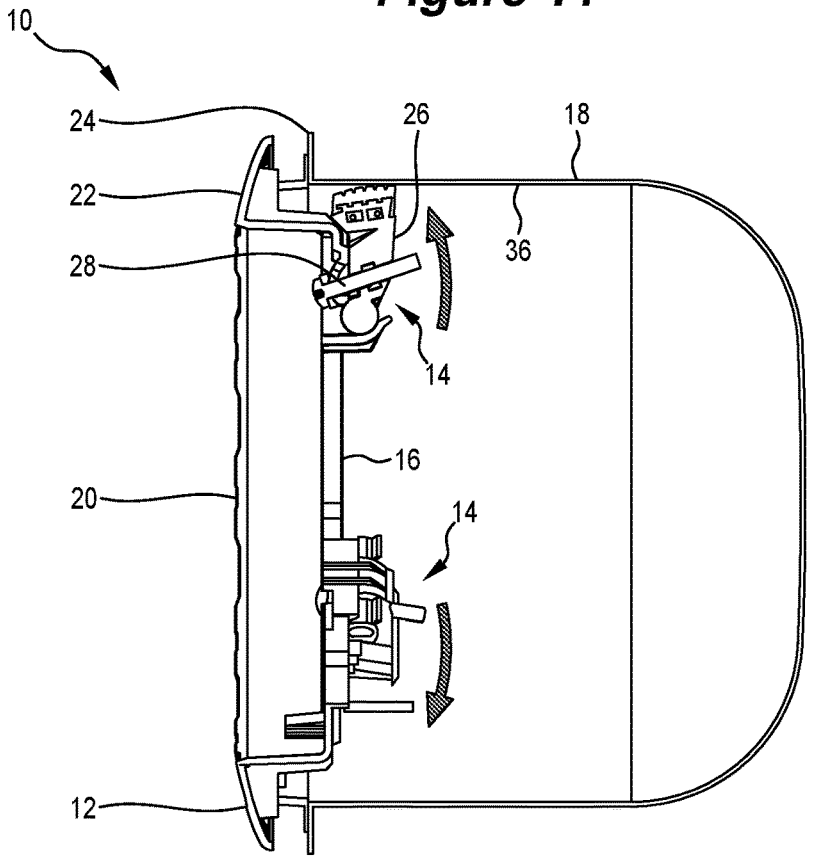
FIG. 12 is a partial cross-sectional side view of the adapter assembly showing the clamping arms in an interference fit with an internal wall of the niche.

The interference fit is also depicted in FIG. 12 wherein multiple niche bore sizes are overlayed.

Figure 11:
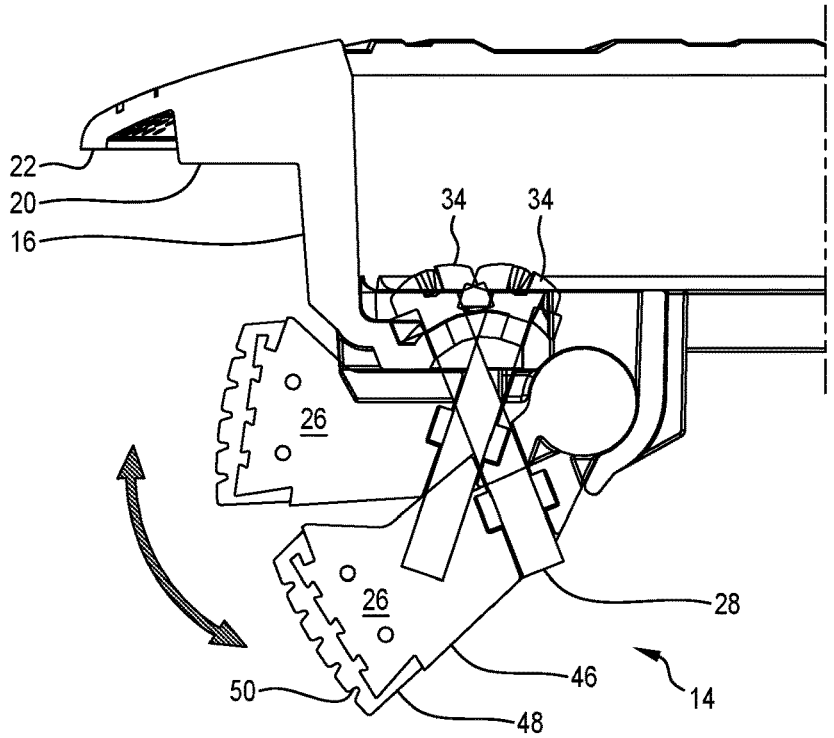
FIG. 11 is a partial cross-sectional side view of the adapter assembly illustrating movement of the clamping arm between the inoperative and operative positions.

FIG. 11 depicts the clamping arm 26 at its two extreme positions. In this figure, and also by comparing FIGS. 9 and 10, it can be seen that the bolt 30 pivots about an axis B. As the bolt 30 is rotated about its own longitudinal axis, the orientation of this axis pivots about axis B as shown. A conical washer 42 is provided to allow the head 34 the bolt 30 to travel over a bearing surface 44 such that compression between the head 34 and the nut 32 causes the clamping arm 26 to rotate about axis A and thereby pull against the surface of the internal wall 36 of the niche 18 as shown in FIG. 12.

For consistency with conventional screw threads, clockwise rotation of the bolt 30 causes the arm 26 to move upwards, with reference to the orientation shown in the figures, and anticlockwise rotation causes the arm 26 to move downwards (away from the niche wall).

In the embodiment shown in FIGS. 5 to 12, the clamping arm 26 is made of a rigid substrate material 46 and the free end of the arm is over-moulded with a flexible material 48. This arrangement provides a degree of compliance, and thus a flexible interface, as the free end of the clamping arm 26 engages the internal wall 36 of the niche 18. The flexible interface is then able to conform to uneven surfaces of the internal walls of the niche. The over-moulding process also allows for a manufactured part that is injection moulded and does not require further manual assembly or adjustment by the installer.

In the embodiment shown in the figures, the flexible material 48 is provided with an asymmetrical toothed or notched profile 50 to increase grip with the internal wall of the niche. The asymmetrical shape provides a greater degree of friction with the internal wall 36 in one direction than in the other direction, to thereby resist unintended removal of the adapter assembly 10 from the niche 18.

The preferred embodiment of the adapter assembly includes three independently adjustable clamping devices 14, each having a defined travel path controlled by independent drive members 28. The assembly can thereby cater for a relatively wide range of niche size variations to provide a secure mechanical retention, while providing even and distributed load around the niche diameter.

Some key advantages of the preferred form of the adapter assembly include:

- universal fit to all major swimming pool niches (concrete pools);
- universal fit to all variations of major niches for vinyl and fibreglass pool constructions;
- applies even, distributed pressure to ensure a secure fixing and prevent damage to the mating niche;
- flexible interface of clamping arms provides secure grip on plastic and metal formed niches;
- toothed or notched profile of the flexible face of the clamping arms aids friction with the internal wall of the niche. The combination of a flexible interface over a rigid clamping arm allows for the force to be applied at the point of contact and to the greatest surface area between the clamping arms and niche wall;
- three independent points of adjustment ensures even and secure fixing even when variation, debris or other foreign items are present in the existing niche, which would otherwise prevent installation;
- can secure at an angle to the original niche, enabling the luminaire to mount flush with the pool wall, potentially correcting previously misaligned luminaires;
- does not disturb the original sealing method;
- plastic materials provide robust support while avoiding crevice and/or galvanic corrosion with the mating niche;
- the three clamping arms move in such a way so as to pull the adaptor plate into the niche as the clamping devices are adjusted;
- each clamping devices is adjusted by a single threaded bolt;
- the clamping devices allow for individual adjustment to suit variations in niche size, geometry and conditions for cases where concrete debris has set inside the niche that could prevent normal installation without repair; and
- uses only readily available tools for installation.

FIGS. 13A to 18D show alternative adapter assemblies in accordance with other embodiments of the invention.

Figure 13A:
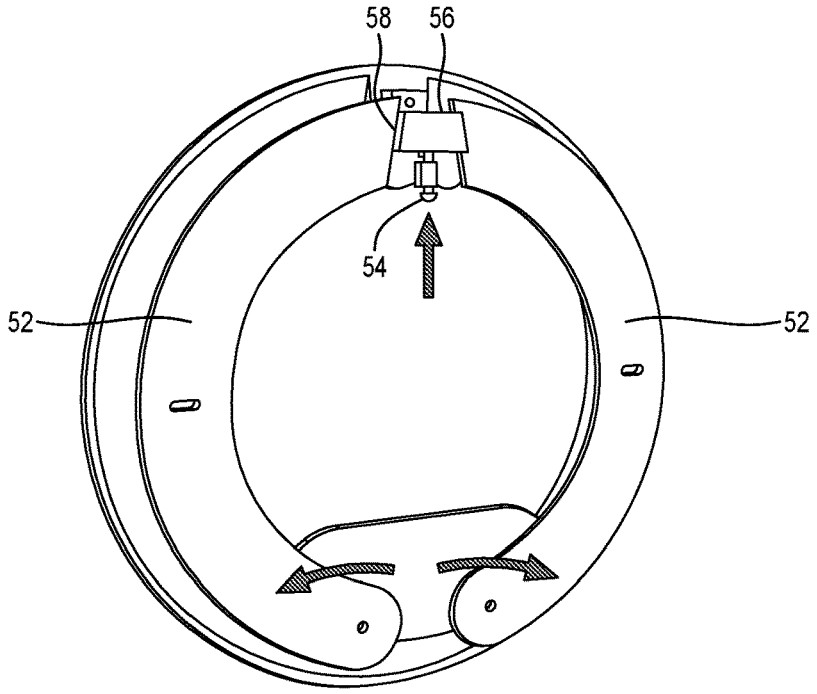
FIGS. 13A-C are rear perspective, rear and alternative rear perspective views of an alternative adapter assembly for securing a luminaire within a niche formed in a wall of a swimming pool or spa, in accordance with a different embodiment of the invention.
Figure 13B:
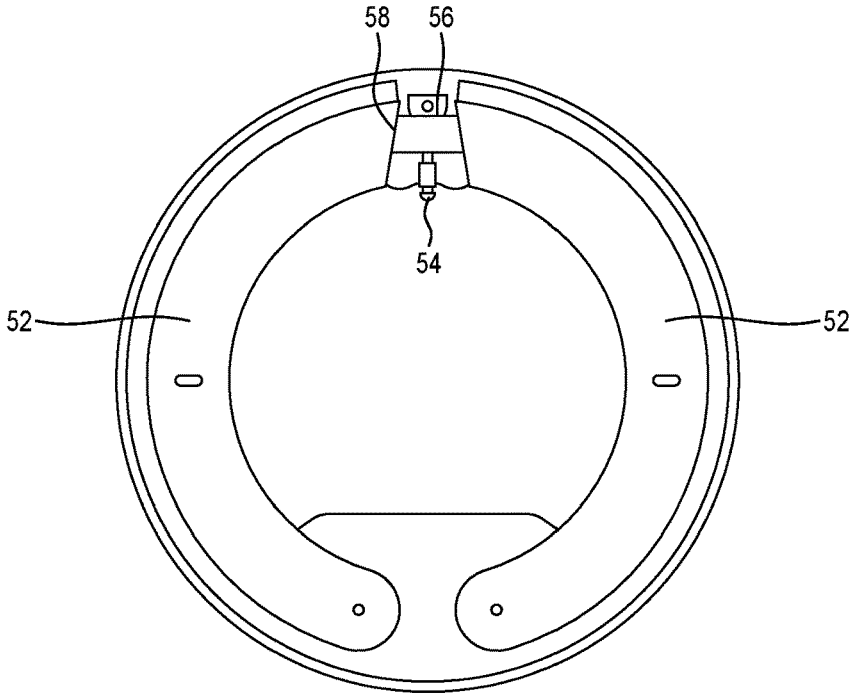
Figure 13C:
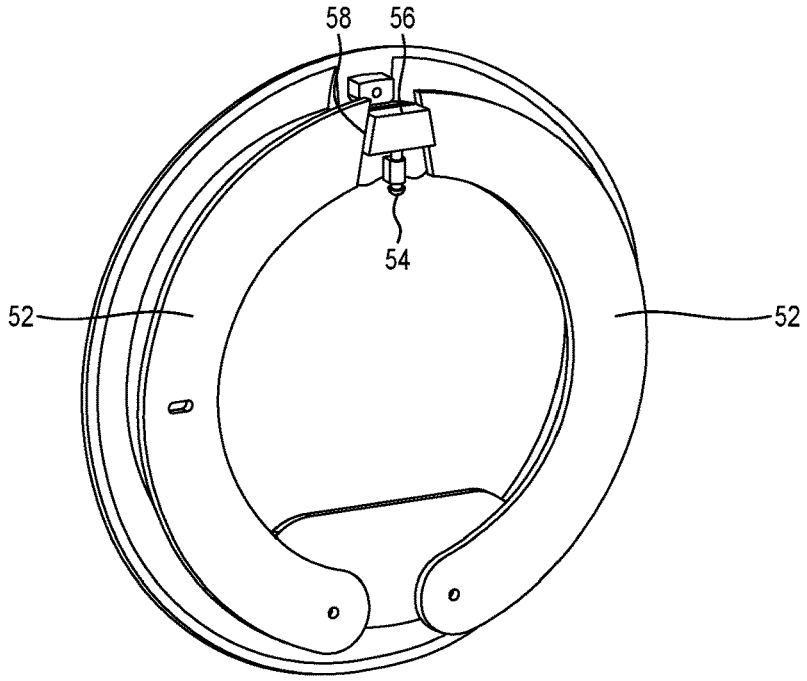
Figure 14A:
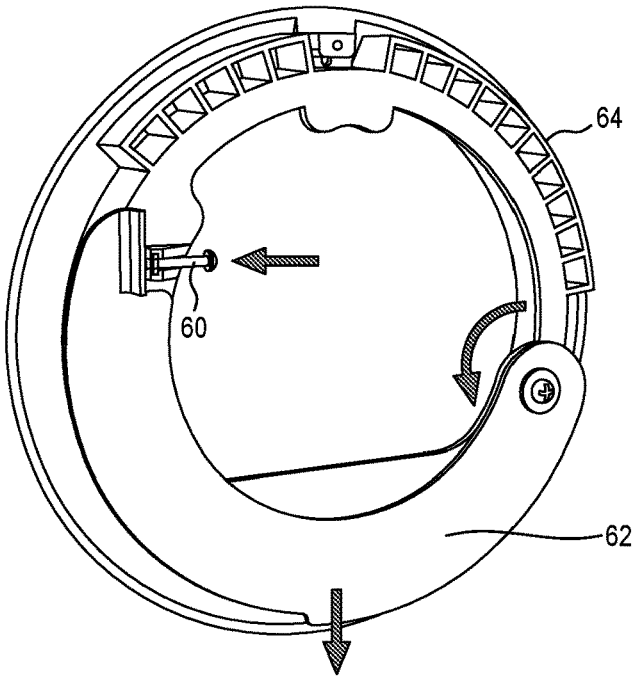
FIGS. 14A-D are rear perspective, front, side and rear views of another alternative adapter assembly in accordance with a different embodiment of the invention.
Figure 14B:
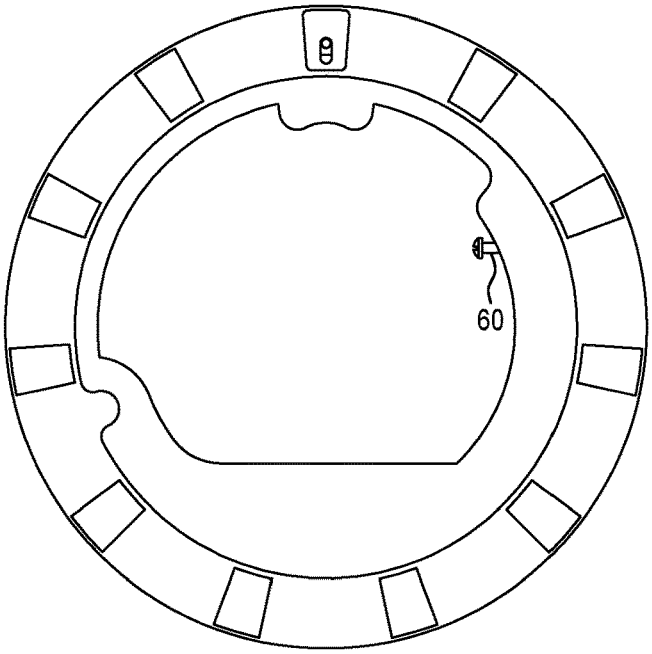
Figure 14C:
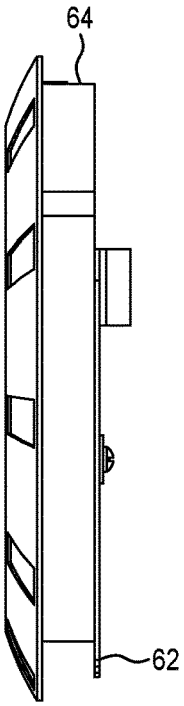
Figure 14D:
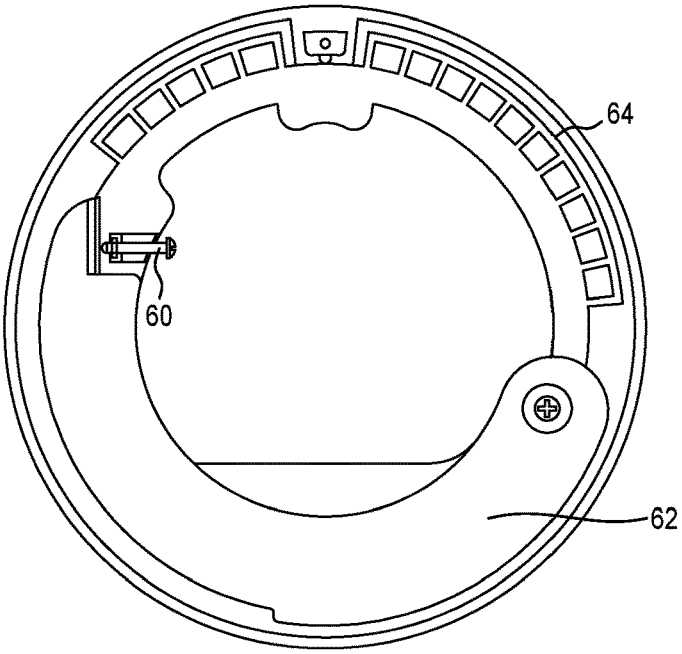

FIGS. 13A-C show a rear view of an adapter assembly which operates similar to the way in which drum brakes work in vehicles. Two semicircular shoes 52 expand outwards to engage the internal wall of the niche to which the adapter assembly has been installed. In this case a single screw 54 drives a wedge 56 outward (away from a central axis of the assembly) with two bearing surfaces 58 forcing the two semicircular shoes 52 that pivot against the internal walls of the niche. The outwards pressure exerts a clamping force into the niche walls thus securing the luminaire into the niche. When the screw 54 is wound in a reverse direction it draws the wedge inwards to release the clamping shoes 52 from the niche walls and allow removal from the niche.

FIGS. 14A-D show another adapter assembly which is a variation of the drum brake concept shown in FIGS. 13A-C. A drive screw 60 acts upon a single semicircular arm 62 that pivots outwards into the bore of the niche. The expansion of the pivoting arm 62 outwards causes the rear portion 64 of the adapter assembly to expand against the opposing surfaces of the niche wall in order to spread the load across a wider surface area of the niche. The expansion of the pivoting arm 62 provides enough force such that the adapter assembly is locked into the niche until the screw 60 is unwound to release the force and allow removal.

Figure 15A:
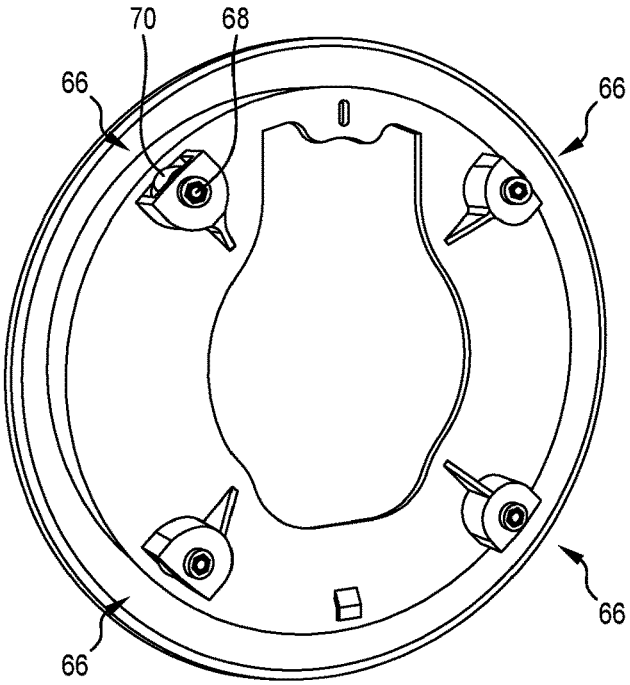
FIGS. 15A-C are rear perspective, partial side cross-section and rear views of another alternative adapter assembly in accordance with a different embodiment of the invention.
Figure 15B:
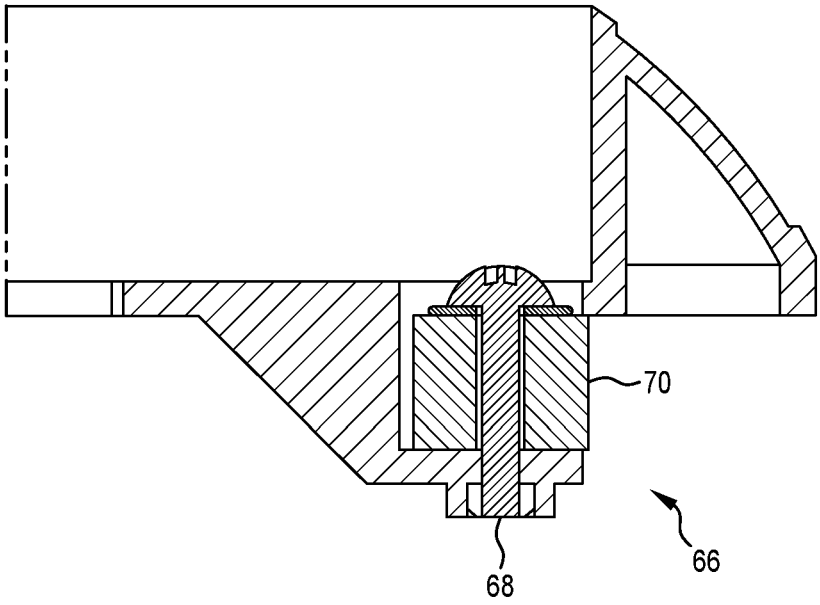
Figure 15C:
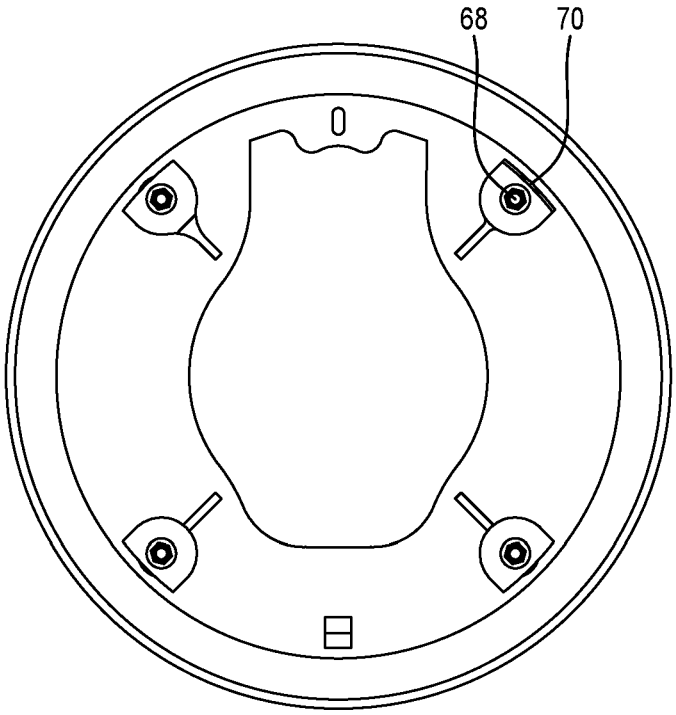

FIGS. 15A-C depict another concept in which four independently adjustable clamping devices 66 rotate as a screw 68 is wound tight to compress a flexible cylindrical block 70, forcing it to expand outwardly and make contact with the inside wall of the niche. The head of each screw 68 is able to be accessed from the front of the adapter assembly and acts on the cylindrical block 70 that, when compressed, bellows symmetrically to make contact with the inside wall of the niche. The flexible block provides a greater level of surface contact than a polymeric material as it conforms to the opposing surface structure of the niche. The four points of contact allow for variability in the niche to mounting bracket concentricity and variability in the niche form.

Figure 16A:
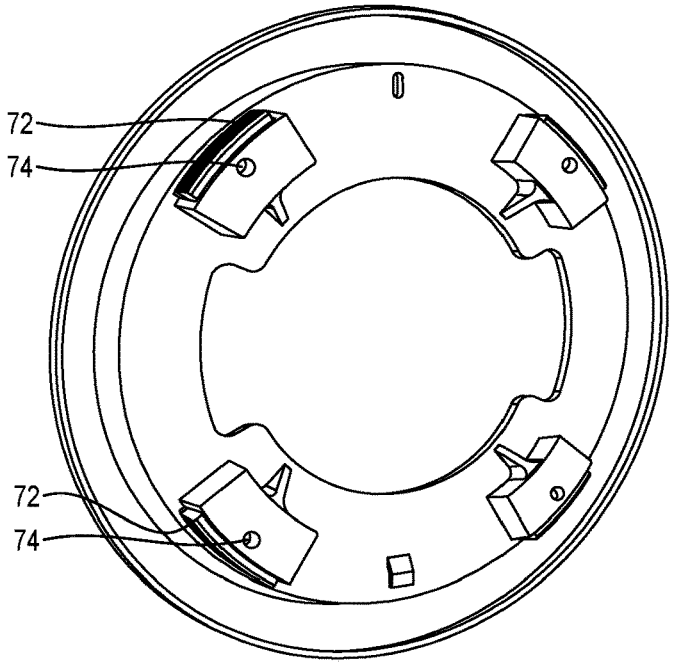
FIGS. 16A-C are rear perspective, partial side cross-section and front perspective views of another alternative adapter assembly in accordance with a different embodiment of the invention.
Figure 16B:
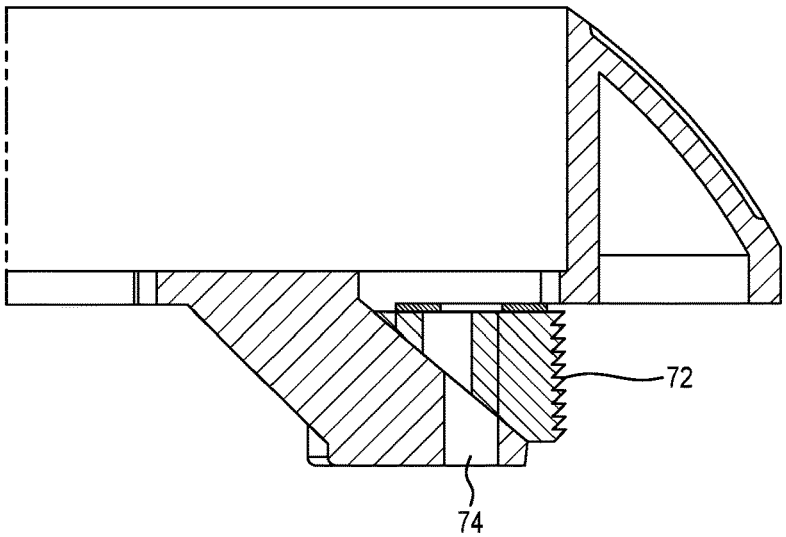
Figure 16C:
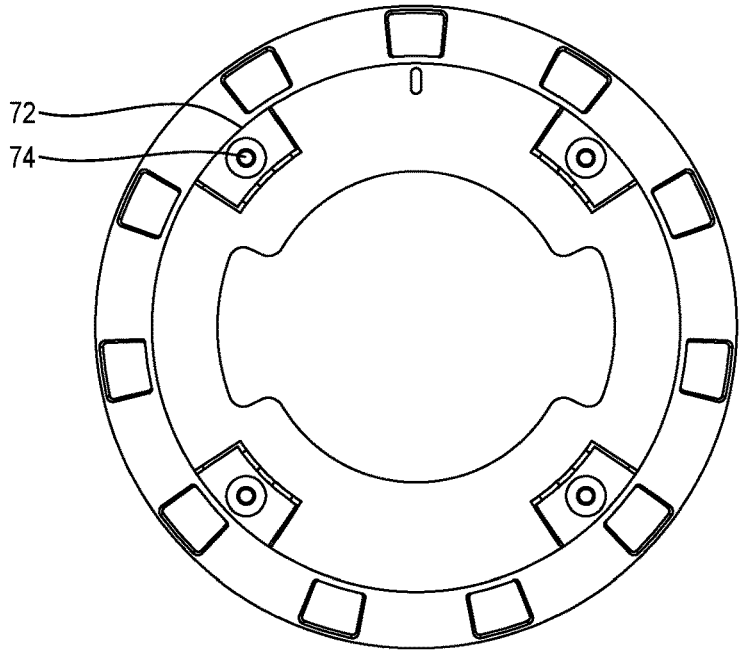

FIGS. 16A-C depict a variation on the concept depicted in FIGS. 15A-C. In this variation, four independently adjustable wedges 72, controlled by screws 74, engage the internal wall of the niche to which it has been installed. The wedges 72 are made of a flexible material with a degree of compliance such that the material expands outward when compressed by the screw 74. Alternatively, each screw, when wound, may engage with a bearing block such that the wedge 72 slides outwards, away from the central axis of the assembly, towards the niche wall. The flexible block 72 provides a greater level of surface contact than a polymeric material as it conforms to the opposing surface structure of the niche.

Figure 17A:
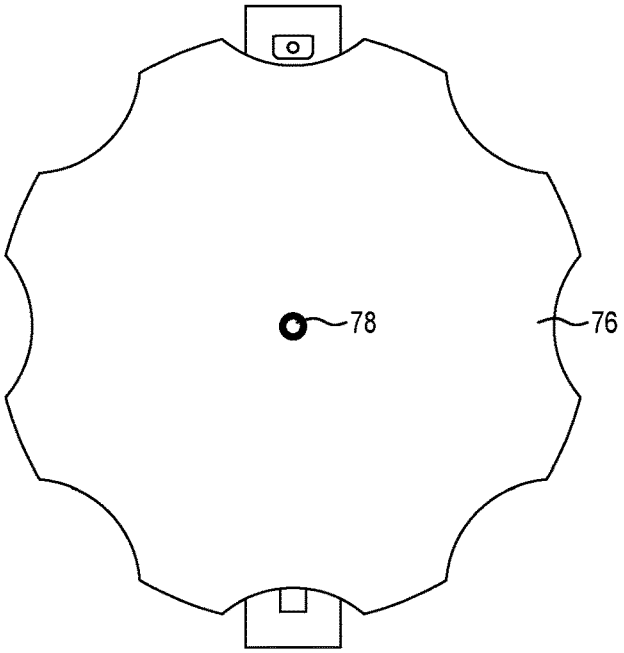
FIGS. 17A-C are rear, side and rear perspective views of another alternative adapter assembly in accordance with a different embodiment of the invention.
Figure 17B:
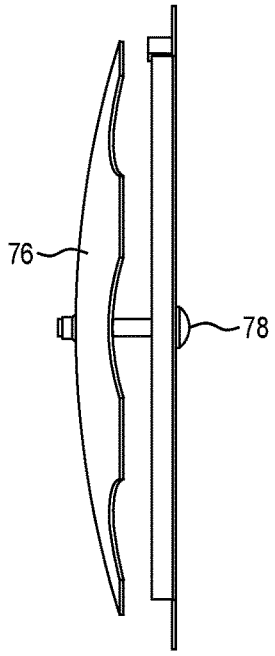
Figure 17C:
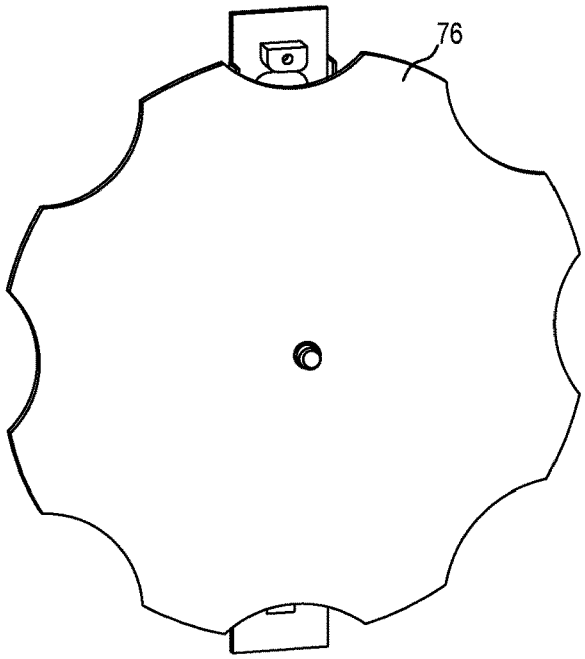
Figure 18A:
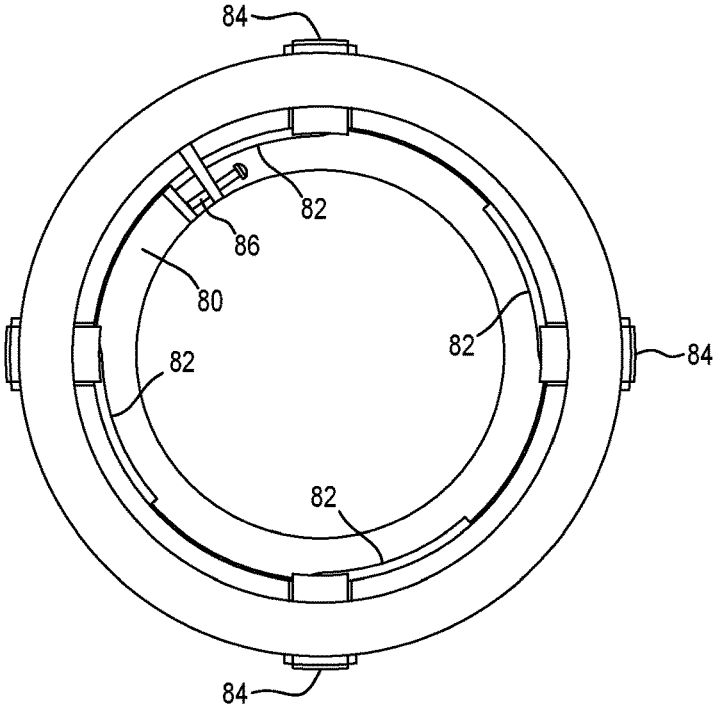
FIGS. 18A-D are rear, front, side, rear and front perspective views of another alternative adapter assembly in accordance with a different embodiment of the invention.
Figure 18B:
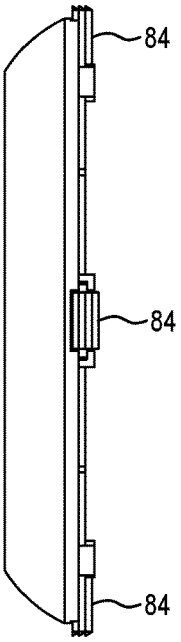
Figure 18C:
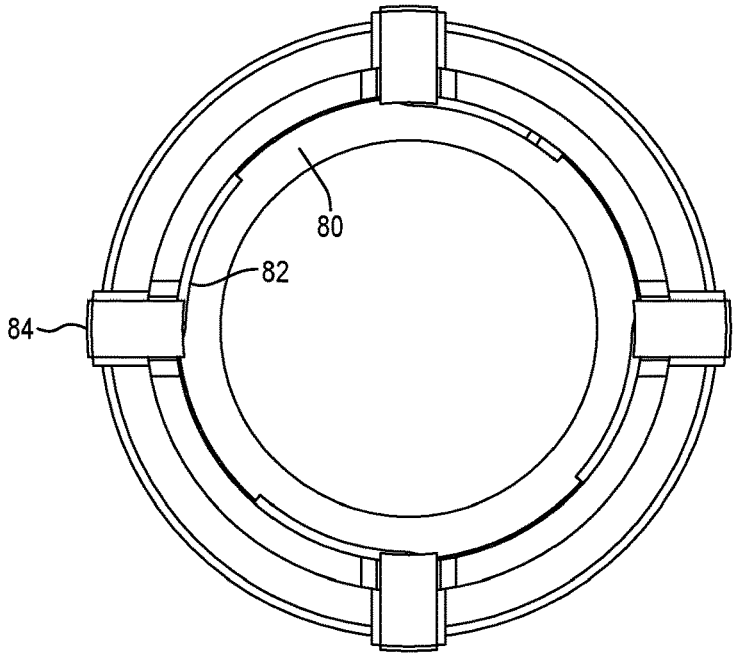
Figure 18D:
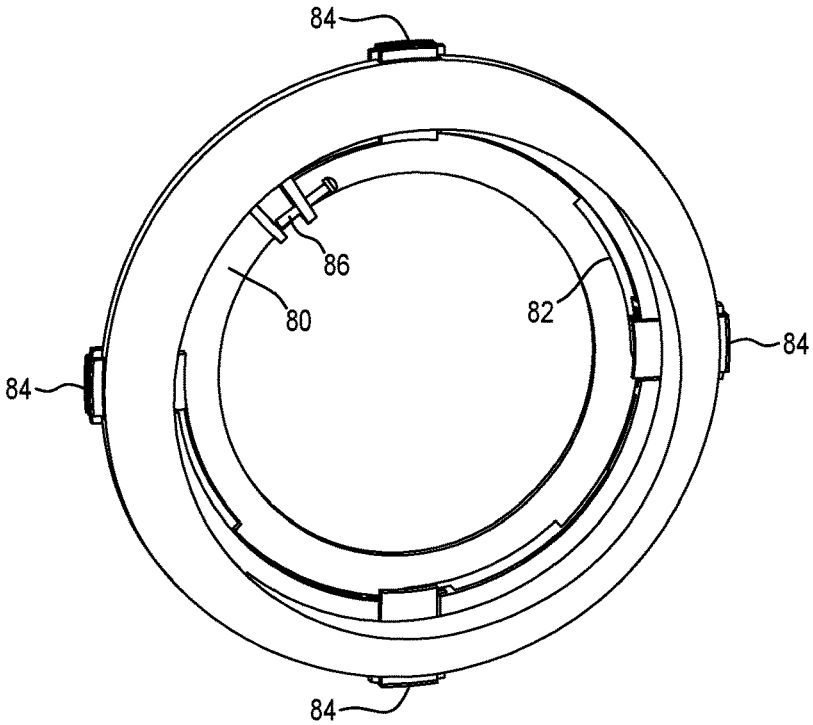

FIGS. 17A-C depict another variation. In this variation a mounting frame comprises of a concave metal plate 76 with several contact points to meet with the inside bore of the niche. A drive member in the form of a threaded bolt 78 axially aligned to the niche and mounting frame provide force to drive the plate 76 from a domed profile to a flat profile. In this adjustment range the edges of the plate 76 act upon the niche wall and the contact points engage as the profile changes and the threaded bolt 78 is tightened. If the bolt 78 is wound back the flattened shape is returned to its normally concaved profile and the retention into the niche is lost, thereby allowing the mounting frame to be removed.

FIGS. 18A-D depict yet another variation. In this concept a central rotating ring gear 80 with four cam surfaces 82 operates on four outwardly-projecting interface blocks 84. A screw 86 rotates the central ring gear 80 which then acts upon the four independent blocks 84 to make contact with the niche wall. More specifically, the screw 86 transfers forces to the ring gear 80 with the four identical cam surfaces 82 that translate the forces equally in the four directions to cause the interface blocks 84 to meet with the inside bore of the niche. The clockwise motion of the ring gear 80 and cams 82 act to secure the adapter assembly to the niche, and the opposite counter clockwise motion releases the assembly.

Although preferred embodiments of the invention are described herein in detail, other variations would become apparent to persons skilled in the art. In each variation, an adapter assembly comprises a mounting bracket and some sort of clamping device. The mounting bracket has a rear portion shaped and sized to fit within the niche and a front portion comprising a peripheral flange sized to engage the wall surface surrounding the niche. The mounting bracket is configured to enable a luminaire to be secured thereto and be visible from a front side thereof. The clamping device(s) attached to the rear portion of the mounting bracket are configured to secure the mounting bracket to the niche. All such variations are considered to fall within the spirit of the invention and the scope of the appended claims.

The invention claimed is:

1. An adapter assembly suitable for securing a luminaire to a niche formed in an internal wall of a pool or spa, the adapter assembly comprising:

a mounting bracket having a rear portion shaped and sized to fit within the niche and a front portion comprising a peripheral flange sized to engage the wall surrounding the niche, the mounting bracket also being configured to enable the luminaire to be secured thereto and be visible from a front side thereof; and at least one clamping device attached to the rear portion of the mounting bracket and being configured to secure the mounting bracket to the niche, wherein the clamping device comprises a clamping arm and wherein the clamping arm comprises a rigid substrate material and a free end of the clamping arm includes a flexible material overlying the rigid substrate material so as to provide a degree of compliance as the free end of the clamping arm engages the internal wall of the niche, the flexible material provided with a toothed or notched profile to increase grip with the internal wall of the niche.

2. The adapter assembly of claim 1 wherein the clamping device further comprises a drive member, the drive member being accessible from the front side of the mounting bracket when the rear portion is positioned within the niche such that, in use, the drive member is operable to drive the clamping arm towards the internal wall of the niche to thereby secure the mounting bracket to the niche.

3. The adapter assembly of claim 2 wherein the clamping arm is pivotally connected to the mounting bracket such that, when operated by the drive member, the free end of the clamping arm moves forwardly towards the front portion of the mounting bracket as it moves outwardly, away from a central axis of the mounting bracket and towards the internal wall of the niche, whereby the combined movement causes the rear portion of the mounting bracket to be drawn further into the niche and the peripheral flange of the mounting bracket to be drawn towards the wall surrounding the niche.

4. The adapter assembly of claim 3 wherein the clamping device includes stop members to limit movement of the clamping arm within predetermined travel limits.

5. The adapter assembly claim 2 wherein the drive member comprises a threaded bolt that is arranged to engage a threaded bore or nut within the clamping arm.

6. The adapter assembly of claim 5 wherein the threaded bolt comprises a head which projects through an aperture in the mounting bracket so as to be accessible from the front side of the mounting bracket when positioned within the niche.

7. The adapter assembly of claim 2 wherein the drive member comprises a threaded bolt that is arranged to engage a threaded bore or nut within the clamping arm.

8. The adapter assembly of claim 7 wherein the threaded bolt comprises a head which projects through an aperture in the mounting bracket so as to be accessible from the front side of the mounting bracket when positioned within the niche.

9. The adapter assembly of claim 1 wherein the toothed or notched profile has an asymmetrical shape to provide a greater degree of friction with the internal wall of the niche in one direction than in the other direction, to thereby resist unintended removal of the adapter assembly from the niche.

10. The adapter assembly of claim 1 wherein three clamping devices are provided, substantially equally spaced around the mounting bracket.

11. The adapter assembly of claim 1 wherein three clamping devices are provided, substantially equally spaced around the mounting bracket.

* * * * *